US012187566B2

(12) United States Patent
Hara et al.

(10) Patent No.: US 12,187,566 B2
(45) Date of Patent: Jan. 7, 2025

(54) CONVEYING APPARATUS

(71) Applicant: RISO KAGAKU CORPORATION, Tokyo (JP)

(72) Inventors: Masashi Hara, Ibaraki (JP); Yoshifumi Noguchi, Ibaraki (JP); Yoshiyuki Okada, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 239 days.

(21) Appl. No.: 17/587,282

(22) Filed: Jan. 28, 2022

(65) Prior Publication Data

US 2022/0258999 A1 Aug. 18, 2022

(30) Foreign Application Priority Data

Feb. 12, 2021 (JP) ..... 2021-020941

(51) Int. Cl.
*B65H 29/62* (2006.01)
*B65H 5/06* (2006.01)
*B65H 7/06* (2006.01)

(52) U.S. Cl.
CPC ..... *B65H 29/62* (2013.01); *B65H 5/062* (2013.01); *B65H 7/06* (2013.01); *B65H 2301/448* (2013.01); *B65H 2511/528* (2013.01)

(58) Field of Classification Search
CPC ..... B65H 29/62; B65H 5/062; B65H 7/06; B65H 2301/448; B65H 2511/528
See application file for complete search history.

(56) References Cited

U.S. PATENT DOCUMENTS 8,579,283 B2 * 11/2013 Isobe ..... B65H 5/26 271/65
2013/0134645 A1 * 5/2013 Kato ..... G03G 15/6544 270/58.07
2014/0339756 A1 * 11/2014 Harada ..... B65H 29/62 271/215
2016/0275389 A1 * 9/2016 Hara ..... G06K 15/16
2016/0318731 A1 11/2016 Kowase et al.
2020/0239252 A1 * 7/2020 Komuro ..... B65H 5/026

FOREIGN PATENT DOCUMENTS

| | | |
|---|---|---|
| CN | 111497441 | 8/2020 |
| JP | 2014-221547 | 11/2014 |
| JP | 2016-212188 | 12/2016 |
| JP | 2017-107014 | 6/2017 |
| JP | 2019-130755 | 8/2019 |
| JP | 2020-121839 | 8/2020 |

OTHER PUBLICATIONS

China Official Action received in CN Application No. 202210110712.3, dated Mar. 20, 2024.
Japanese Official Action issued in Japanese application No. 2021-020941, dated Oct. 1, 2024.

* cited by examiner

*Primary Examiner* — Thomas A Morrison
(74) *Attorney, Agent, or Firm* — Greenblum & Bernstein, P.L.C.

(57) ABSTRACT

A controller, upon occurrence of a sheet jam in a downstream conveyor, discharges a sheet in an upstream conveyor from a discharge port by controlling an operation of a switchback roller depending on an operation status of the switchback roller at a time of the occurrence of the sheet jam and then stops sheet conveyance by a conveyor.

3 Claims, 7 Drawing Sheets

CONVEYING APPARATUS

CROSS REFERENCE TO RELATED APPLICATION

This application is based upon and claims the benefit of priority from the prior Japanese Patent Application No. 2021-020941 filed on Feb. 12, 2021, the entire contents of which are incorporated herein by reference.

BACKGROUND

1. Technical Field

The disclosure relates to a conveying apparatus which conveys sheets.

2. Related Art

There is a known printing system in which multiple printers are connected in series.

The printing system above is required to perform various functions along with an increase in printing speed. To address this requirement, the printing system allows connection with optional apparatuses such as an image inspection apparatus and a sheet discharger.

The printing system including the optional apparatuses above becomes large in size and the sheet conveyance route becomes long. Thus, when a sheet jam occurs and a sheet conveyance operation is stopped, the number of sheets remaining in the conveyance route becomes large and labor for removing the sheets increases accordingly.

In connection with the above, Japanese Patent Application Publication No. 2019-130755 discloses a printing system in which an intermediate sheet discharge tray is provided in an intermediate apparatus arranged between two printers and configured to reverse a sheet upside down. In this printing system, when a sheet jam occurs, sheets are discharged to the intermediate sheet discharge tray in order to prevent the sheets from being conveyed to an inkjet head unit of an upstream printer and an inkjet head unit of a downstream printer. This technique reduces the number of sheets remaining in the apparatuses at the time of the occurrence of a jam and reduces labor for removing the sheets.

SUMMARY

The technique above requires a driving mechanism which is for conveying sheets from the downstream printer to the intermediate sheet discharge tray in a direction opposite to the direction during printing and which is not necessary for the printing operation itself. Provision of such additional mechanisms for handling a jam leads to an increase in the size of the system.

The disclosure is directed to a conveying apparatus capable of reducing labor for removing sheets remaining in a printing system at the time of the occurrence of a jam without an additional mechanism for handling the jam.

A conveying apparatus in accordance with some embodiments includes: a conveyor including an upstream conveyor configured to convey a sheet, a switchback roller configured to feed the sheet in reverse by receiving and conveying the sheet from the upstream conveyor by a normal rotation operation and then conveying the sheet by a reverse rotation operation, and a downstream conveyor configured to convey the sheet fed in reverse by the switchback roller; a discharge port arranged downstream of the switchback roller in a conveyance direction of the sheet conveyed by the normal rotation operation of the switchback roller; and a controller configured to, upon occurrence of a sheet jam in the downstream conveyor, discharge a sheet in the upstream conveyor from the discharge port by controlling an operation of the switchback roller depending on an operation status of the switchback roller at a time of the occurrence of the sheet jam, and then stop sheet conveyance by the conveyor.

According to the aforementioned configuration, it is possible to reduce labor for removing sheets remaining in a printing system at the time of the occurrence of a jam while preventing an increase in the size of the printing system.

DETAILED DESCRIPTION

Figure 1:
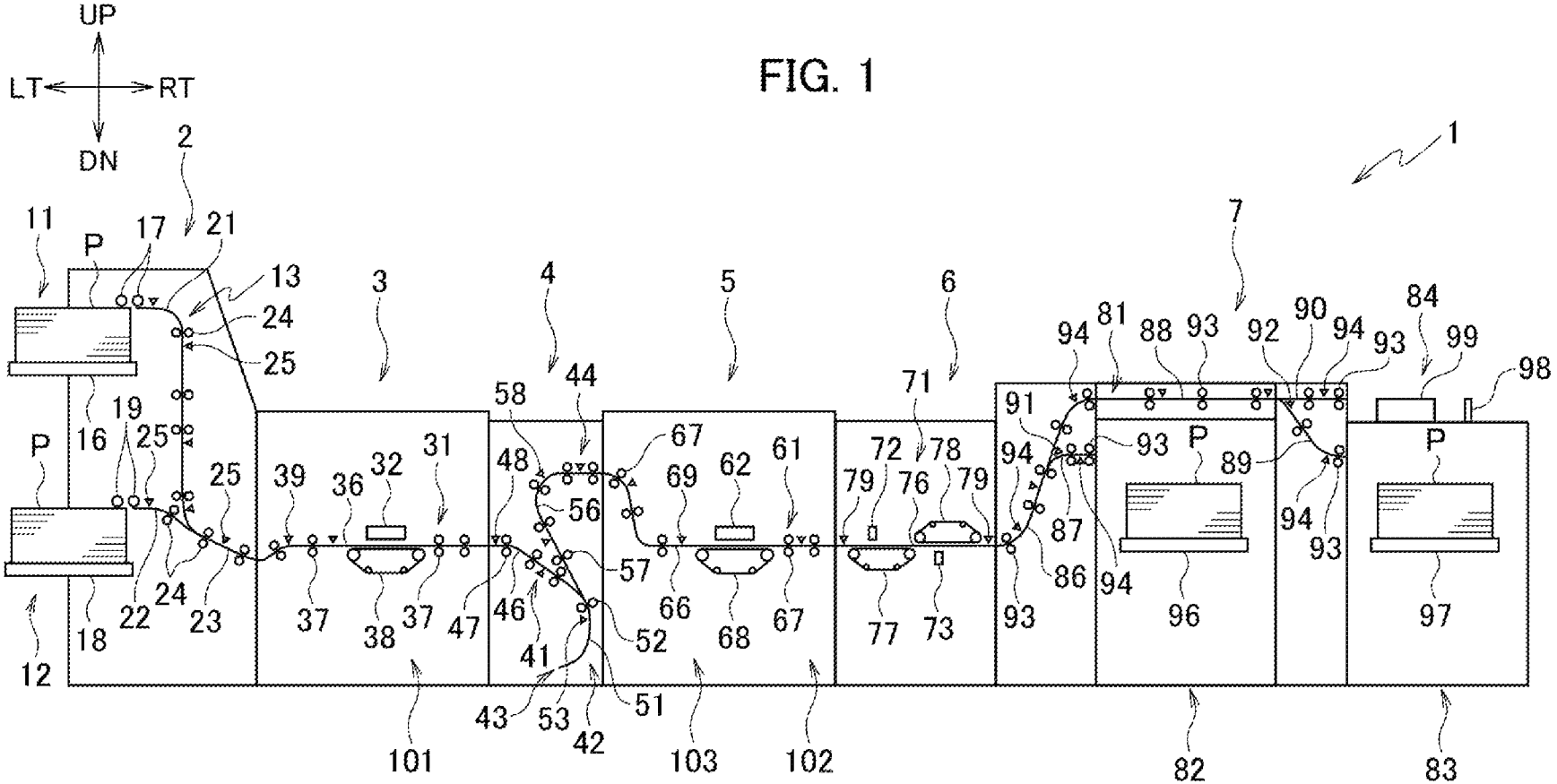
FIG. 1 is a schematic configuration diagram of a printing system according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from that in reality.

Figure 2:
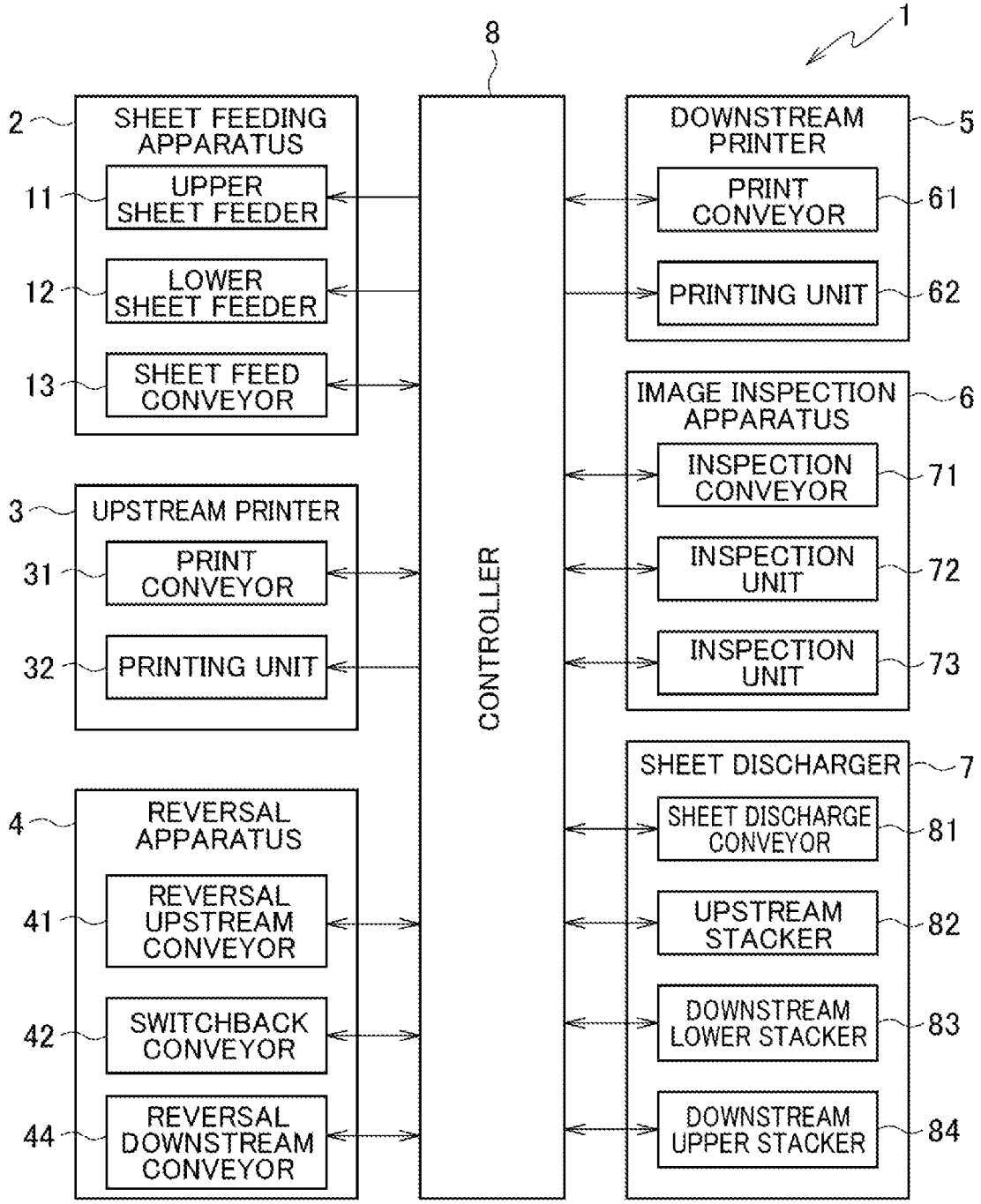
FIG. 2 is a control block diagram of the printing system illustrated in FIG. 1.
Figure 3:
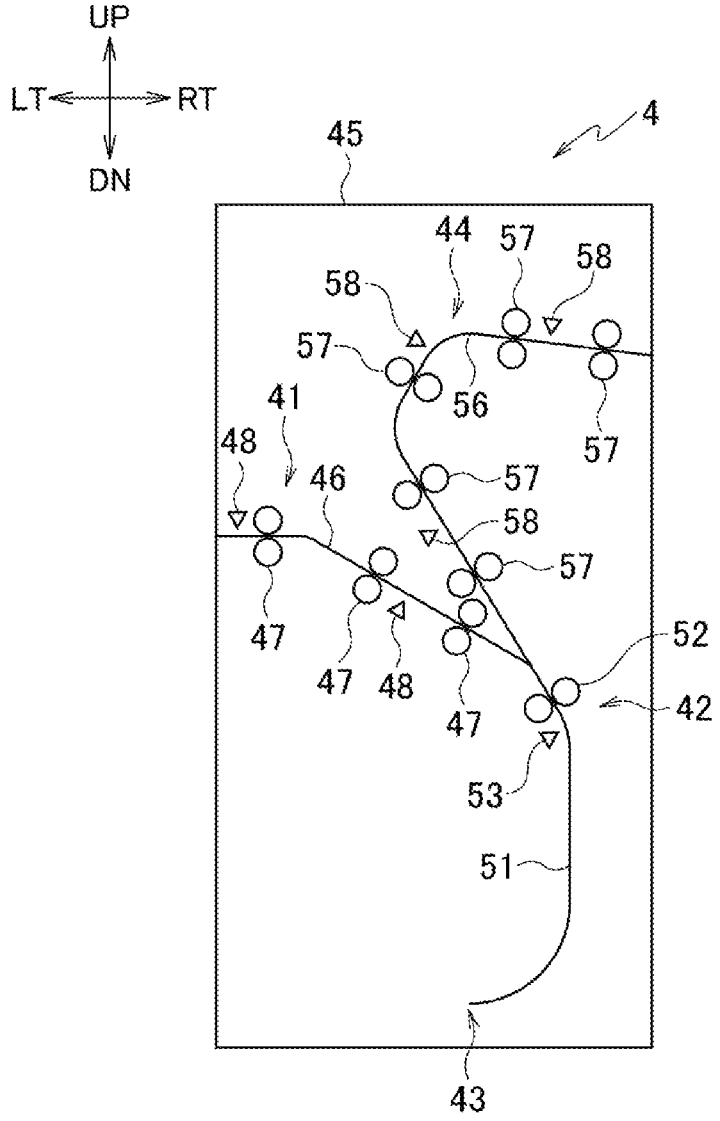
FIG. 3 is a schematic configuration diagram of a reversal apparatus of the printing system illustrated in FIG. 1.

FIG. 1 is a schematic configuration diagram of a printing system 1 provided with a conveying apparatus according to an embodiment of the present invention. FIG. 2 is a control block diagram of the printing system 1 illustrated in FIG. 1. FIG. 3 is a schematic configuration diagram of a reversal apparatus 4 of the printing system 1 illustrated in FIG. 1. In the following description, right and left in the page space of FIG. 1 is referred to as the right-left direction and up and down is referred to as the up-down direction. In FIGS. 1, 3, and 5 to 7, the directions of right, left, up, and down are denoted by RT, LT, UP, and DN, respectively.

As illustrated in FIGS. 1 and 2, the printing system 1 includes a sheet feeding apparatus 2, an upstream printer 3, the reversal apparatus 4, a downstream printer 5, an image inspection apparatus 6, a sheet discharger 7, and a controller 8. The conveying apparatus is formed of the components of the printing system 1 other than an upper sheet feeder 11, a lower sheet feeder 12, printing units 32, 62, inspection units 72, 73, an upstream stacker 82, and a downstream upper stacker 84 described later.

The sheet feeding apparatus 2 feeds a sheet P to the upstream printer 3. The sheet feeding apparatus 2 includes the upper sheet feeder 11, the lower sheet feeder 12, and a sheet feed conveyor 13.

The upper sheet feeder 11 feeds a sheet P to an upper sheet feed route 21 described later. The upper sheet feeder 11 includes an upper sheet feed tray 16 and upper sheet feed rollers 17.

The upper sheet feed tray 16 is a tray on which sheets P to be used in printing are stacked. The upper sheet feed tray 16 is vertically movable (i.e. capable of lifting and lowering).

The upper sheet feed rollers 17 pick up a sheet P from the upper sheet feed tray 16 and feed the sheet P to the upper sheet feed route 21.

The lower sheet feeder 12 feeds a sheet P to a lower sheet feed route 22 described later. The lower sheet feeder 12 includes a lower sheet feed tray 18 and lower sheet feed rollers 19.

The lower sheet feed tray 18 is a tray on which sheets P to be used in printing are stacked. The lower sheet feed tray 18 is arranged below the upper sheet feed tray 16.

The lower sheet feed rollers 19 pick up a sheet P from the lower sheet feed tray 18 and feed the sheet P to the lower sheet feed route 22.

The sheet feed conveyor 13 conveys a sheet P picked up from the upper sheet feed tray 16 and a sheet P picked up from the lower sheet feed tray 18 to the upstream printer 3. The sheet feed conveyor 13 includes the upper sheet feed route 21, the lower sheet feed route 22, a common sheet feed route 23, conveyance rollers 24, and sheet sensors 25.

The upper sheet feed route 21 is a conveyance route for conveying a sheet P from the upper sheet feed tray 16 to the common sheet feed route 23.

The lower sheet feed route 22 is a conveyance route for conveying a sheet P from the lower sheet feed tray 18 to the common sheet feed route 23.

The common sheet feed route 23 is a conveyance route for conveying a sheet P conveyed along the upper sheet feed route 21 and a sheet P conveyed along the lower sheet feed route 22 to the upstream printer 3. The common sheet feed route 23 is connected to a downstream end of the upper sheet feed route 21 and a downstream end of the lower sheet feed route 22 in the conveyance direction of the sheet P.

The conveyance rollers 24 are arranged along the upper sheet feed route 21, the lower sheet feed route 22, and the common sheet feed route 23 and convey a sheet P to the upstream printer 3.

The sheet sensors 25 are arranged along the upper sheet feed route 21, the lower sheet feed route 22, and the common sheet feed route 23 and detect a sheet P conveyed in the sheet feed conveyor 13.

The upstream printer 3 conveys a sheet P fed by the sheet feeding apparatus 2, while performing printing on one surface of the sheet P. The upstream printer 3 includes a print conveyor 31 and the printing unit 32.

The print conveyor 31 receives a sheet P from the sheet feeding apparatus 2 and conveys the received sheet P. The print conveyor 31 includes a print conveyance route 36, conveyance rollers 37, a belt platen 38, and sheet sensors 39.

The print conveyance route 36 is a conveyance route along which a sheet P is conveyed below the printing unit 32. An upstream end of the print conveyance route 36 is connected to a downstream end of the common sheet feed route 23.

Some conveyance rollers 37 of the conveyance rollers 37 are arranged along the print conveyance route 36 at an upstream side of the belt platen 38 and convey a sheet P to the belt platen 38. The remaining conveyance rollers 37 are arranged along the print conveyance route 36 at a downstream side of the belt platen 38 and convey a sheet P to the reversal apparatus 4.

The belt platen 38 conveys a sheet P while sucking and holding the sheet P on a belt. The belt platen 38 is arranged below the printing unit 32 to face the printing unit 32.

The sheet sensors 39 are arranged along the print conveyance route 36 and detect a sheet P conveyed in the print conveyor 31.

The printing unit 32 includes inkjet heads (not illustrated) and performs printing by ejecting ink from the inkjet heads onto a sheet P conveyed by the belt platen 38.

The reversal apparatus 4 reverses a sheet P conveyed from the upstream printer 3 upside down and conveys the reversed sheet P to the downstream printer 5. As illustrated in FIG. 3, the reversal apparatus 4 includes a reversal upstream conveyor 41, a switchback conveyor 42, an intermediate discharge port (discharge port) 43, and a reversal downstream conveyor 44.

The reversal upstream conveyor 41 conveys a sheet P to the switchback conveyor 42. The reversal upstream conveyor 41 includes a reversal upstream route 46, conveyance rollers 47, and sheet sensors 48.

The reversal upstream route 46 is a conveyance route for conveying a sheet P from the upstream printer 3 to the switchback conveyor 42. An upstream end of the reversal upstream route 46 is connected to a downstream end of the print conveyance route 36 of the upstream printer 3. A downstream end of the reversal upstream route 46 is connected to one end (upper end) of a switchback route 51 described later.

The conveyance rollers 47 are arranged along the reversal upstream route 46 and convey a sheet P to the switchback conveyor 42.

The sheet sensors 48 are arranged along the reversal upstream route 46 and detect a sheet P conveyed in the reversal upstream conveyor 41.

The switchback conveyor 42 causes a sheet P conveyed from the reversal upstream conveyor 41 to be fed in reverse (that is, switches back a sheet P) and conveys the reverse-fed sheet P to the reversal downstream conveyor 44. The switchback conveyor 42 includes the switchback route 51, switchback rollers 52, and a sheet sensor 53.

The switchback route 51 is a conveyance route for feeding a sheet P in reverse. One end (upper end) of the switchback route 51 is connected to the downstream end of the reversal upstream route 46 and an upstream end of a reversal downstream route 56 described later. At the other end (lower end) of the switchback route 51, the intermediate discharge port 43 is formed.

The switchback rollers 52 are rollers for feeding a sheet P in reverse. The switchback rollers 52 are rotatable forward and reverse in order to feed a sheet P in reverse. The operation by the switchback rollers 52 of conveying a sheet P in the direction from the reversal upstream route 46 to the switchback route 51 is a normal rotation operation and the operation by the switchback rollers 52 of conveying a sheet P in the direction from the switchback route 51 to the reversal downstream route 56 is a reverse rotation operation.

That is, the switchback rollers 52 feeds a sheet P in reverse by receiving and conveying a sheet P from the conveyance rollers 47 of the reversal upstream conveyor 41 by the normal rotation operation and then conveying the sheet P by the reverse rotation operation, and conveys the reversed-fed sheet P to conveyance rollers 57 of the reversal downstream conveyor 44 described later.

The sheet sensor 53 detects a conveyed sheet P at a position adjacent to a downstream side of the switchback rollers 52 in the conveyance direction of a sheet P conveyed by the normal rotation operation of the switchback rollers 52.

The intermediate discharge port 43 is a discharge port for discharging a sheet P from the conveyance route in the reversal apparatus 4. As described above, the intermediate discharge port 43 is formed at the other end (lower end) of the switchback route 51. That is, the intermediate discharge port 43 is arranged at the downstream side of the switchback rollers 52 in the conveyance direction of the sheet P conveyed by the normal rotation operation of the switchback rollers 52.

The sheet P discharged from the intermediate discharge port 43 is stacked on a bottom plate of a chassis 45 of the reversal apparatus 4. Note that a stacking tray on which sheets P discharged from the intermediate discharge port 43 are stacked may be provided.

The reversal downstream conveyor 44 conveys a sheet P fed in reverse by the switchback conveyor 42, to the downstream printer 5. The reversal downstream conveyor 44 includes the reversal downstream route 56, the conveyance rollers 57, and sheet sensors 58.

The reversal downstream route 56 is a conveyance route for conveying a sheet P from the switchback conveyor 42 to the downstream printer 5. The upstream end of the reversal downstream route 56 is connected to one end (upper end) of the switchback route 51.

The conveyance rollers 57 are arranged along the reversal downstream route 56 and convey a sheet P to the downstream printer 5. In the present embodiment, the respective conveyance rollers 57 are configured to convey a sheet P only in the direction to the downstream printer 5. Note that the most upstream conveyance rollers 57 of the conveyance rollers 57 correspond to downstream conveyance rollers which receive a sheet P from the switchback rollers 52 and convey the received sheet P.

The sheet sensors 58 are arranged along the reversal downstream route 56 and detect a sheet P conveyed by the reversal downstream conveyor 44.

The downstream printer 5 conveys a sheet P reversed upside down by the reversal apparatus 4, while performing printing on the other surface of the sheet P. The downstream printer 5 includes a print conveyor 61 and the printing unit 62.

The print conveyor 61 receives a sheet P from the reversal apparatus 4 and conveys the received sheet P. The print conveyor 61 includes a print conveyance route 66, conveyance rollers 67, a belt platen 68, and sheet sensors 69.

The print conveyance route 66 is a conveyance route along which a sheet P is conveyed below the printing unit 62. An upstream end of the print conveyance route 66 is connected to a downstream end of the reversal downstream route 56.

Some conveyance rollers 67 of the conveyance rollers 67 are arranged along the print conveyance route 66 at an upstream side of the belt platen 68 and convey a sheet P to the belt platen 68. The remaining conveyance rollers 67 are arranged along the print conveyance route 66 at a downstream side of the belt platen 68 and convey a sheet P to the image inspection apparatus 6.

The belt platen 68 conveys a sheet P while sucking and holding the sheet P on a belt. The belt platen 68 is arranged below the printing unit 62 to face the printing unit 62.

The sheet sensors 69 are arranged along the print conveyance route 66 and detect a sheet P conveyed in the print conveyor 61.

The printing unit 62 includes inkjet heads (not illustrated) and performs printing by ejecting ink from the inkjet heads onto a sheet P conveyed by the belt platen 68.

The image inspection apparatus 6 inspects images printed on both surfaces of a sheet P by the upstream printer and the downstream printer 5. The image inspection apparatus 6 includes an inspection conveyor 71 and inspection units 72, 73.

The inspection conveyor 71 receives a sheet P from the downstream printer 5 and conveys the received sheet P. The inspection conveyor 71 includes an inspection conveyance route 76, belt platens 77, 78, and sheet sensors 79.

The inspection conveyance route 76 is a conveyance route for conveying a sheet P such that the sheet P passes through reading regions of the inspection units 72, 73. An upstream end of the inspection conveyance route 76 is connected to a downstream end of the print conveyance route 66.

The belt platen 77 conveys a sheet P conveyed from the downstream printer 5 while sucking and holding the sheet P on a belt. The belt platen 77 is installed such that a conveyance surface of the belt platen 77 on which the sheet P is sucked and held faces upward.

The belt platen 78 receives a sheet P from the belt platen 77 and conveys the received sheet P. The belt platen 78 is installed such that a conveyance surface of the belt platen 78 faces downward and the belt platen 78 conveys the sheet P while sucking and holding the sheet P on the conveyance surface facing downward.

The sheet sensors 79 are arranged along the inspection conveyance route 76 and detect a sheet P conveyed in the inspection conveyor 71.

The inspection unit 72 reads the image on the upward surface of a sheet P conveyed by the belt platen 77 for inspection. The inspection unit 73 reads the image on the downward surface of a sheet P conveyed by the belt platen 78 for inspection.

The sheet discharger 7 discharges a sheet P printed by the upstream printer 3 and the downstream printer 5. The sheet discharger 7 includes a sheet discharge conveyor 81, an upstream stacker 82, a downstream lower stacker 83, and a downstream upper stacker 84.

The sheet discharge conveyor 81 receives a sheet P from the image inspection apparatus 6, conveys the received sheet P, and discharges the sheet P selectively to the upstream stacker 82, the downstream lower stacker 83, or the downstream upper stacker 84. The sheet discharge conveyor 81 includes a common sheet discharge route 86, an upstream sheet discharge route 87, a downstream common sheet discharge route 88, a downstream lower sheet discharge route 89, a downstream upper sheet discharge route 90, switchers 91, 92, conveyance rollers 93, and sheet sensors 94.

The common sheet discharge route 86 is a common conveyance route for a sheet P conveyed to the upstream stacker 82, the downstream lower stacker 83, or the downstream upper stacker 84 in the sheet discharge conveyor 81.

An upstream end of the common sheet discharge route 86 is connected to a downstream end of the inspection conveyance route 76.

The upstream sheet discharge route 87 is a conveyance route for conveying and discharging a sheet P to the upstream stacker 82. An upstream end of the upstream sheet discharge route 87 is connected to a downstream end of the common sheet discharge route 86.

The downstream common sheet discharge route 88 is a common conveyance route for a sheet P conveyed to the downstream lower stacker 83 or the downstream upper stacker 84. An upstream end of the downstream common sheet discharge route 88 is connected to the downstream end of the common sheet discharge route 86.

The downstream lower sheet discharge route 89 is a conveyance route for conveying and discharging a sheet P to the downstream lower stacker 83. An upstream end of the downstream lower sheet discharge route 89 is connected to a downstream end of the downstream common sheet discharge route 88.

The downstream upper sheet discharge route 90 is a conveyance route for conveying and discharging a sheet P to the downstream upper stacker 84. An upstream end of the downstream upper sheet discharge route 90 is connected to the downstream end of the downstream common sheet discharge route 88.

The switcher 91 switches the conveyance destination of a sheet P conveyed downstream from the common sheet discharge route 86, between the upstream sheet discharge route 87 and the downstream common sheet discharge route 88. The switcher 92 switches the conveyance destination of a sheet P conveyed downstream from the downstream common sheet discharge route 88, between the downstream lower sheet discharge route 89 and the downstream upper sheet discharge route 90.

The conveyance rollers 93 are arranged along the common sheet discharge route 86, the upstream sheet discharge route 87, the downstream common sheet discharge route 88, the downstream lower sheet discharge route 89, and the downstream upper sheet discharge route 90 and convey a sheet P to be discharged in the sheet discharger 7.

The sheet sensors 94 are arranged along the common sheet discharge route 86, the upstream sheet discharge route 87, the downstream common sheet discharge route 88, the downstream lower sheet discharge route 89, and the downstream upper sheet discharge route 90 and detect a sheet P conveyed in the sheet discharge conveyor 81.

The upstream stacker 82 accommodates sheets P discharged from the upstream sheet discharge route 87. The upstream stacker 82 includes a sheet discharge tray 96 capable of lifting and lowering. Sheets P are discharged to and stacked on the sheet discharge tray 96. The upstream stacker 82 includes an end fence which restricts the position of a front edge (downstream edge) of a sheet P discharged onto the sheet discharge tray 96, a guide member which restricts the position of a rear edge (upstream edge) of a sheet P, and a pair of side fences which restrict the position of a sheet P in the width direction of the sheet P (not illustrated).

The downstream lower stacker 83 accommodates sheets P discharged from the downstream lower sheet discharge route 89. The downstream lower stacker 83 includes a sheet discharge tray 97 capable of lifting and lowering. Sheets P are discharged to and stacked on the sheet discharge tray 97. Similarly to the upstream stacker 82, the downstream lower stacker 83 includes an end fence, a guide member, and a pair of side fences (not illustrated).

The downstream upper stacker 84 accommodates sheets P discharged from the downstream upper sheet discharge route 90. The downstream upper stacker 84 includes an end fence 98 and a pair of side fences 99.

The end fence 98 restricts the position of the front edge (downstream edge) of a sheet P discharged onto the downstream upper stacker 84. The end fence 98 is movable in the right and left direction.

The pair of side fences 99 restrict the position of a sheet P discharged onto the downstream upper stacker 84 in the width direction of the sheet P. The side fences 99 are movable in the width direction of the sheet P.

In the printing system 1, the sheet feed conveyor 13, the print conveyor 31 of the upstream printer 3, and the reversal upstream conveyor 41 form an upstream conveyor 101. The reversal downstream conveyor 44, the print conveyor 61 of the downstream printer 5, the inspection conveyor 71, and the sheet discharge conveyor 81 form a downstream conveyor 102. The upstream conveyor 101, the switchback rollers 52, and the downstream conveyor 102 form a conveyor 103.

The controller 8 controls operations of the respective apparatuses (the sheet feeding apparatus 2, the upstream printer 3, the reversal apparatus 4, the downstream printer 5, the image inspection apparatus 6, and the sheet discharger 7) of the printing system 1. The controller 8 is formed of microcomputers provided in the respective apparatuses of the printing system 1.

When a jam of a sheet P occurs in the downstream conveyor 102, the controller 8 discharges a sheet(s) P in the upstream conveyor 101 from the intermediate discharge port 43 by controlling the operation of the switchback rollers 52 depending on the operation status of the switchback rollers 52 at the time of the occurrence of the jam, and then stops the conveyance of sheets P by the conveyor 103.

As the operation status of the switchback rollers 52, the controller 8 determines whether the switchback rollers 52 are in the normal rotation operation or in the reverse rotation operation, and further determines whether a sheet P being conveyed by the switchback rollers 52 has reached the most upstream conveyance rollers 57 of the reversal downstream conveyor 44 when the controller 8 determines that the switchback rollers 52 are in the reverse rotation operation.

Next, operations of the printing system 1 will be described.

When printing is performed in the printing system 1, the sheet feeding apparatus 2 picks up a sheet P from the upper sheet feeder 11 or the lower sheet feeder 12 and feeds the sheet P to the upstream printer 3. The upstream printer 3 conveys the sheet P, while performing printing on one surface of the sheet P by means of the printing unit 32.

The reversal apparatus 4 reverses the sheet P having the one surface printed by the upstream printer 3, upside down by means of the switchback conveyor 42, and conveys the reversed sheet P to the downstream printer 5 with the other surface (not printed yet) facing upward. The downstream printer 5 conveys the sheet P, while performing printing on the other surface of the sheet P by means of the printing unit 62. As a result, images are printed on both surfaces of the sheet P.

The image inspection apparatus 6 inspects the images printed on both surfaces of the sheet P and conveys the sheet P to the sheet discharger 7. The sheet discharger 7 discharges the printed sheet P to the upstream stacker 82, the downstream lower stacker 83, or the downstream upper stacker 84.

Next, operations of the printing system 1 in the case where a jam of a sheet P occurs in the downstream conveyor 102 during the printing operation above will be described.

During the printing operation, the controller 8 determines that a jam has occurred in the downstream conveyor 102 (downstream of the switchback rollers 52) when the detection timing of a sheet P at least at one of the sensors 58 of the reversal downstream conveyor 44 of the reversal apparatus 4, the sensors 69 of the downstream printer 5, the sensors 79 of the image inspection apparatus 6, or the sensors 94 of the sheet discharger 7 is later than a theoretical value by a threshold value or more.

Figure 4:
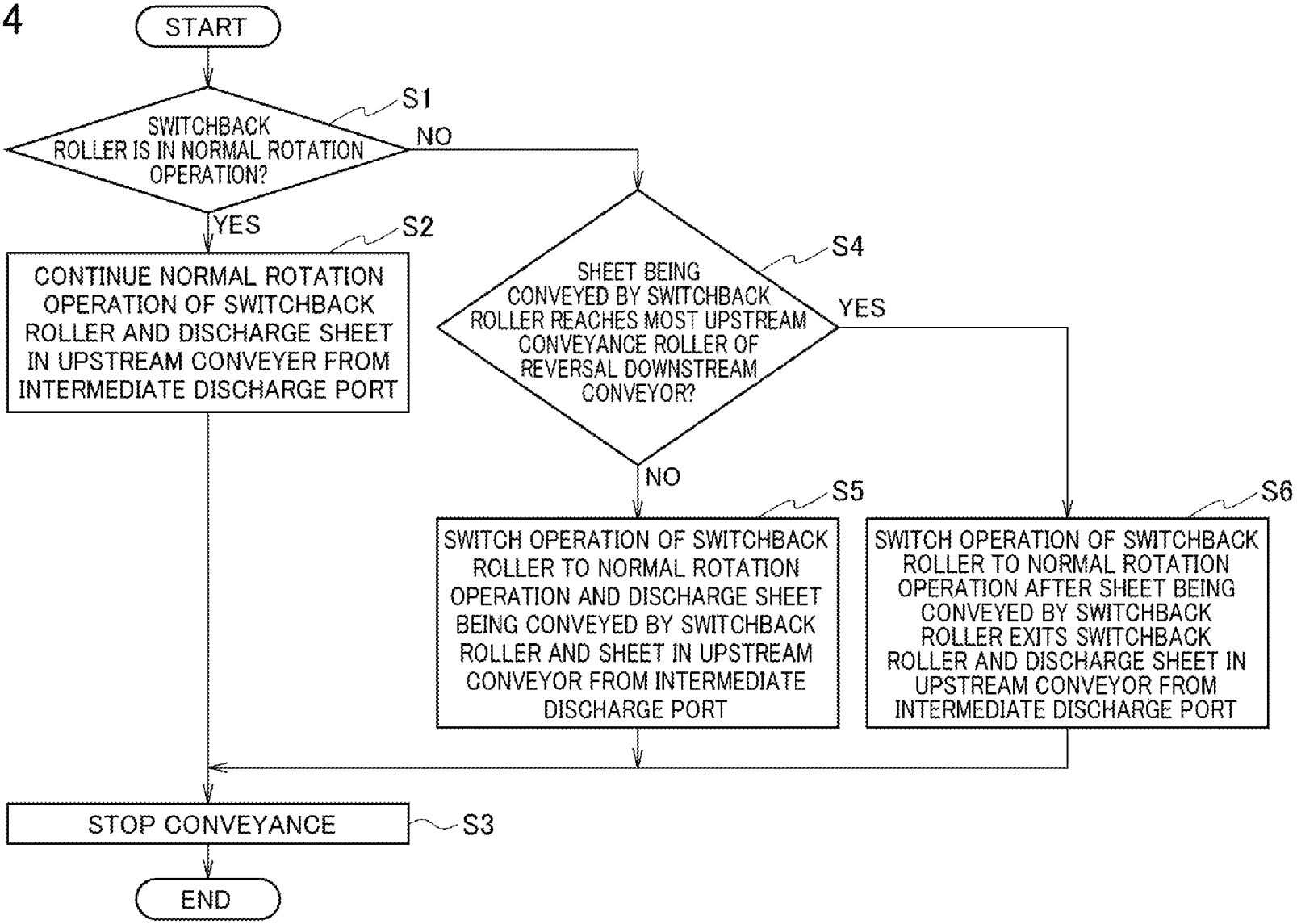
FIG. 4 is a flowchart for explaining operations of the printing system in a case where a sheet jam occurs in a downstream conveyor.

FIG. 4 is a flowchart for explaining operations of the printing system 1 in the case where a jam of a sheet P occurs in the downstream conveyor 102.

When the controller 8 determines that a jam has occurred in the downstream conveyor 102, in step S1 in FIG. 4, the controller 8 determines whether the switchback rollers 52 are in the normal rotation operation at the time of the occurrence of the jam.

When the controller 8 determines that the switchback rollers 52 are in the normal rotation operation (step S1: YES), the controller 8 continues the normal rotation operation of the switchback rollers 52 and discharges a sheet(s) P in the upstream conveyor 101 from the intermediate discharge port 43.

Figure 5:
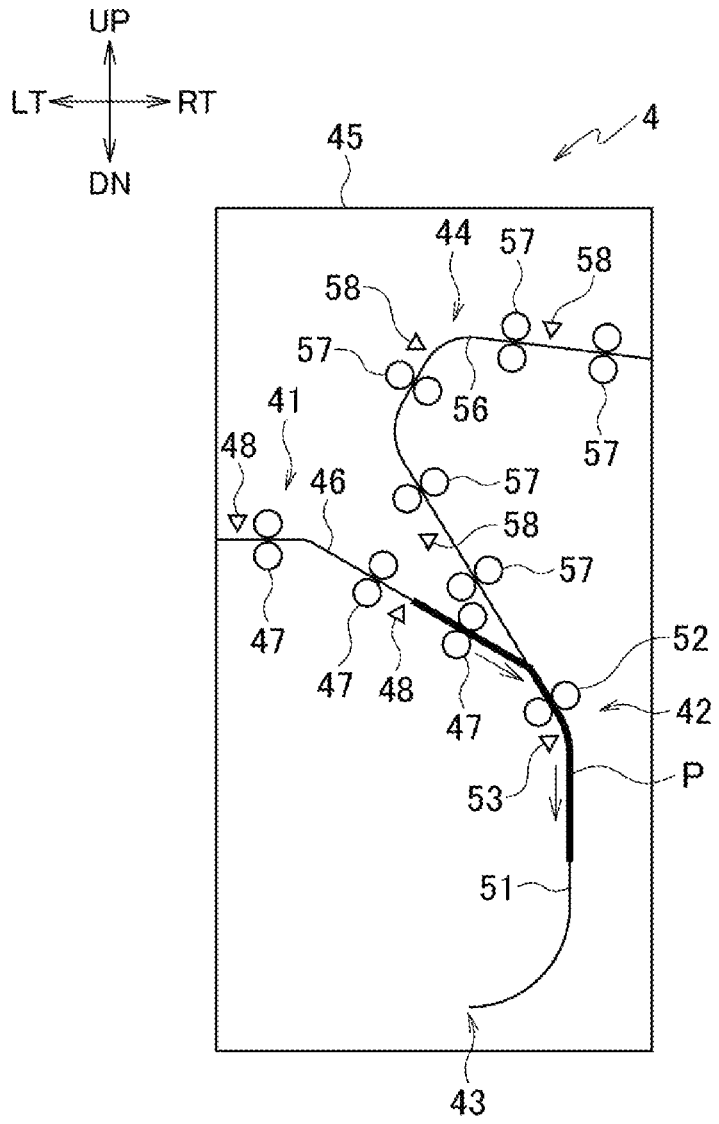
FIG. 5 is a diagram depicting a state where a switchback roller is in a normal rotation operation.

In the case where the switchback rollers 52 are in the normal rotation operation at the time of the occurrence of the jam in the downstream conveyor 102 and a sheet P being conveyed by the switchback rollers 52 is present as illustrated in FIG. 5, this sheet P is discharged from the intermediate discharge port 43 by continuing the normal rotation operation, and then the sheet(s) P conveyed from the upstream conveyor 101 is conveyed to and discharged from the intermediate discharge port 43 by the switchback rollers 52. Feeding of sheets P by the upper sheet feeder 11 and the lower sheet feeder 12 is stopped at the time of the occurrence of the jam.

In the case where the switchback rollers 52 are in the normal rotation operation and are not conveying a sheet P unlike the state illustrated in FIG. 5, by continuing the normal rotation operation, the sheet(s) P conveyed from the upstream conveyor 101 is conveyed to and discharged from the intermediate discharge port 43 by the switchback rollers 52.

During a period from the exiting of a reverse-fed sheet P from the switchback rollers 52 to the arrival of the next sheet P at the switchback rollers 52, the switchback rollers 52 wait for a sheet P in the normal rotation operation. Thus, there is a state where the switchback rollers 52 are in the normal rotation operation without conveying a sheet P.

After all of the sheets P which were present in the upstream conveyor 101 at the time of the occurrence of the jam in the downstream conveyor 102 are discharged from the intermediate discharge port 43, in step S3 in FIG. 4, the controller 8 stops the conveyance of sheets P by the conveyor 103. The series of operations is thereby completed.

In the downstream conveyor 102, sheets P located downstream of the occurrence location of the jam are discharged to the upstream stacker 82, the downstream lower stacker 83, or the downstream upper stacker 84 by the sheet discharger 7. In the case where discharge of all of the sheets P located downstream of the occurrence location of the jam in the downstream conveyor 102 has not been completed at the timing when all of the sheets P which were present in the upstream conveyor 101 are discharged from the intermediate discharge port 43, the controller 8 stops the conveyance of sheets P by the conveyor 103, after completing discharge of all of the sheets P located downstream of the occurrence location of the jam.

Note that a sheet(s) P remaining upstream of the occurrence location of the jam in the downstream conveyor 102 is removed manually by a user.

Sheets P discharged from the intermediate discharge port 43 are stacked on the bottom plate of the chassis 45 of the reversal apparatus 4 as described above and thus the user can easily remove the sheets P.

When the controller 8 determines that the switchback rollers 52 are in the reverse rotation operation at the time of the occurrence of the jam in step S1 (step S1: NO), in step S4, the controller 8 determines whether the sheet P being conveyed by the switchback rollers 52 has reached the most upstream conveyance rollers 57 of the reversal downstream conveyor 44. The controller 8 is able to determine whether the sheet P being conveyed by the switchback rollers 52 has reached the most upstream conveyance rollers 57 of the reversal downstream conveyor 44 based on the elapsed time from the start of the reverse rotation operation of the switchback rollers 52, for example.

Figure 6:
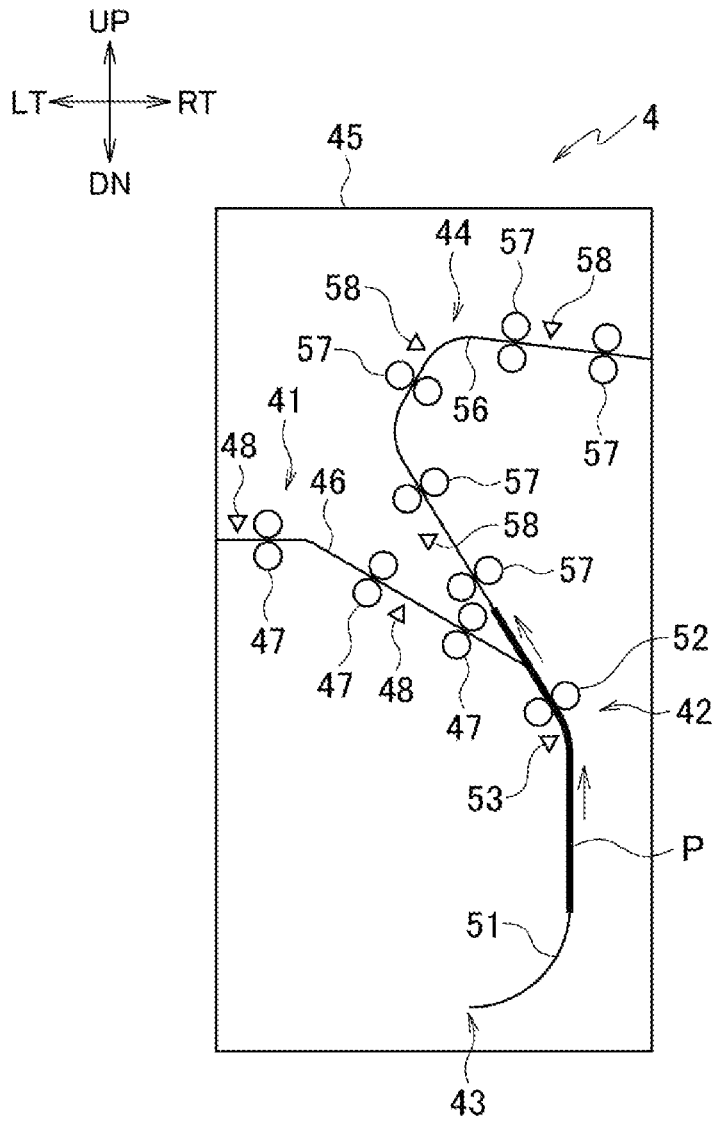
FIG. 6 is a diagram depicting a state where a switchback roller is in a reverse rotation operation and a sheet being conveyed by the switchback roller has not reached the most upstream conveyance roller of a reversal downstream conveyor.
Figure 7:
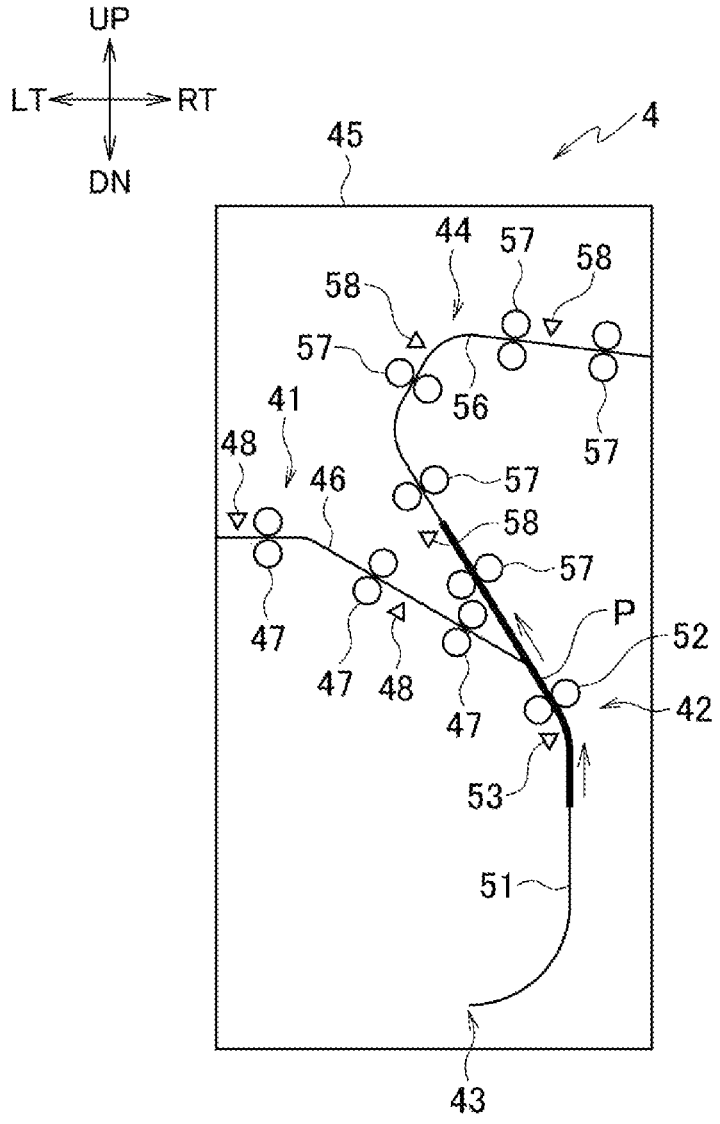
FIG. 7 is a diagram depicting a state where the switchback roller is in the reverse rotation operation and the sheet being conveyed by the switchback roller has reached the most upstream conveyance roller of the reversal downstream conveyor.

FIG. 6 illustrates a state where the sheet P being conveyed by the switchback rollers 52 in the reverse rotation operation has not reached the most upstream conveyance rollers 57 of the reversal downstream conveyor 44. FIG. 7 illustrates a state where the sheet P being conveyed by the switchback rollers 52 in the reverse rotation operation has reached the most upstream conveyance rollers 57 of the reversal downstream conveyor 44.

When the controller 8 determines in step S4 that the sheet P being conveyed by the switchback rollers 52 has not reached the most upstream conveyance rollers 57 of the reversal downstream conveyor 44 as illustrated in FIG. 6 (step S4: NO), in step S5 in FIG. 4, the controller 8 switches the operation of the switchback rollers 52 to the normal rotation operation before the sheet P being conveyed by the switchback rollers 52 reaches the most upstream conveyance rollers 57 of the reversal downstream conveyor 44, discharges the sheet P being conveyed by the switchback rollers 52 from the intermediate discharge port 43, and then discharges the sheet(s) P in the upstream conveyor 101 from the intermediate discharge port 43. Thereafter, the controller 8 proceeds to step S3.

When the controller 8 determines in step S4 that the sheet P being conveyed by the switchback rollers 52 has reached the most upstream conveyance rollers 57 of the reversal downstream conveyor 44 as illustrated in FIG. 7 (step S4: YES), in step S6 in FIG. 4, the controller 8 switches the operation of the switchback rollers 52 to the normal rotation operation after the sheet P being conveyed by the switchback rollers 52 exits the switchback rollers 52 and then discharges the sheet(s) P in the upstream conveyor 101 from the intermediate discharge port 43. Thereafter, the controller 8 proceeds to step S3.

The controller 8 is able to determine whether the sheet P being conveyed by the switchback rollers 52 has exited the switchback rollers 52 based on the elapsed time from the detection of the rear edge of the sheet P being conveyed by the switchback rollers 52 by the sheet sensor 53 of the switchback conveyor 42, for example.

As described above, the respective conveyance rollers 57 are configured to convey a sheet P only in the direction to the downstream printer 5. Thus, the sheet P being conveyed by the switchback rollers 52 in the state of FIG. 7 cannot be conveyed to and discharged from the intermediate discharge port 43. In contrast, by switching the operation of the switchback rollers 52 to the normal rotation operation after the sheet P being conveyed by the switchback rollers 52 exits the switchback rollers 52 as described above, the sheet(s) P in the upstream conveyor 101 can be discharged from the intermediate discharge port 43.

As explained above, in the printing system 1, when a jam of a sheet P occurs in the downstream conveyor 102, the controller 8 discharges a sheet(s) P in the upstream conveyor 101 from the intermediate discharge port 43 by controlling the operation of the switchback rollers 52 depending on the operation status of the switchback rollers 52 at the time of the occurrence of the jam, and then stops the conveyance of sheets P by the conveyor 103. Thus, the number of sheets P remaining in the printing system 1 after stopping the conveyance of sheets P due to the occurrence of a jam can be reduced without an additional mechanism for handling a jam. As a result, it is possible to prevent an increase in the size of the printing system 1 while reducing labor for removing sheets P remaining in the printing system 1 at the time of the occurrence of the jam.

Specifically, when the switchback rollers 52 are in the normal rotation operation at the time of the occurrence of the jam in the downstream conveyor 102, the controller 8 continues the normal rotation operation of the switchback rollers 52, discharges a sheet P being conveyed by the switchback rollers 52 from the intermediate discharge port 43 if a sheet P is being conveyed by the switchback rollers 52 at the time of the occurrence of the jam, and then discharges the sheet(s) P in the upstream conveyor 101 from the intermediate discharge port 43. Thus, it is possible to realize a process of discharging the sheet(s) P in the upstream conveyor 101 from the intermediate discharge port 43 even in the operation status of the switchback rollers 52 where the switchback rollers 52 are in the normal rotation operation at the time of the occurrence of the jam.

When the switchback rollers 52 are in the reverse rotation operation at the time of the occurrence of the jam in the downstream conveyor 102 and a sheet being conveyed by the switchback rollers 52 has not reached the most upstream conveyance rollers 57 of the reversal downstream conveyor 44, the controller 8 switches the operation of the switchback rollers 52 to the normal rotation operation before the sheet P being conveyed by the switchback rollers 52 reaches the most upstream conveyance rollers 57, discharges the sheet P being conveyed by the switchback rollers 52 from the intermediate discharge port 43, and then discharges the sheet(s) P in the upstream conveyor 101 from the intermediate discharge port 43. Thus, it is possible to realize a process of discharging the sheet(s) P in the upstream conveyor 101 from the intermediate discharge port 43 even in the operation status of the switchback rollers 52 where the switchback rollers 52 are in the reverse rotation operation at the time of the occurrence of the jam in the downstream conveyor 102 and the sheet being conveyed by the switchback rollers 52 has not reached the most upstream conveyance rollers 57 of the reversal downstream conveyor 44.

When the switchback rollers 52 are in the reverse rotation operation at the time of the occurrence of the jam in the downstream conveyor 102 and a sheet P being conveyed by the switchback rollers 52 has reached the most upstream conveyance rollers 57 of the reversal downstream conveyor 44, the controller 8 switches the operation of the switchback rollers 52 to the normal rotation operation after the sheet P being conveyed by the switchback rollers 52 exits the switchback rollers 52 and discharges the sheet(s) P in the upstream conveyor 101 from the intermediate discharge port 43. Thus, it is possible to realize a process of discharging the sheet(s) P in the upstream conveyor 101 from the intermediate discharge port 43 even in the operation status of the switchback rollers 52 where the switchback rollers 52 are in the reverse rotation operation at the time of the occurrence of the jam in the downstream conveyor 102 and the sheet P being conveyed by the switchback rollers 52 has reached the most upstream conveyance rollers 57 of the reversal downstream conveyor 44.

Embodiments of the disclosure include, for example, the following configurations.

A conveying apparatus includes: a conveyor including an upstream conveyor configured to convey a sheet, a switchback roller configured to feed the sheet in reverse by receiving and conveying the sheet from the upstream conveyor by a normal rotation operation and then conveying the sheet by a reverse rotation operation, and a downstream conveyor configured to convey the sheet fed in reverse by the switchback roller; a discharge port arranged downstream of the switchback roller in a conveyance direction of the sheet conveyed by the normal rotation operation of the switchback roller; and a controller configured to, upon occurrence of a sheet jam in the downstream conveyor, discharge a sheet in the upstream conveyor from the discharge port by controlling an operation of the switchback roller depending on an operation status of the switchback roller at a time of the occurrence of the sheet jam, and then stop sheet conveyance by the conveyor.

The controller may be configured to, upon the switchback roller being in the normal rotation operation at the time of the occurrence of the sheet jam in the downstream conveyor, continue the normal rotation operation of the switchback roller, discharge a sheet being conveyed by the switchback roller from the discharge port if a sheet being conveyed by the switchback roller is present at the time of the occurrence of the sheet jam, and then discharge the sheet in the upstream conveyor from the discharge port.

The downstream conveyor may include a downstream conveyance roller configured to receive a sheet from the switchback roller and convey the sheet. The controller may be configured to, upon the switchback roller being in a reverse rotation operation at the time of the occurrence of the sheet jam in the downstream conveyor and a sheet being conveyed by the switchback roller not having reached the downstream conveyance roller, switch the operation of the switchback roller to the normal rotation operation before the sheet being conveyed by the switchback roller reaches the downstream conveyance roller, discharge the sheet being conveyed by the switchback roller at the time of the occurrence of the sheet jam from the discharge port, and then discharge the sheet in the upstream conveyor from the discharge port.

The downstream conveyor may include a downstream conveyance roller configured to receive a sheet from the switchback roller and convey the sheet. The controller may be configured to, upon the switchback roller being in a reverse rotation operation at the time of the occurrence of the sheet jam in the downstream conveyor and a sheet being conveyed by the switchback roller having reached the downstream conveyance roller, switch the operation of the switchback roller to the normal rotation operation after the sheet being conveyed by the switchback roller exits the switchback roller, and discharge the sheet in the upstream conveyor from the discharge port.

Embodiments of the present invention have been described above. However, the invention may be embodied in other specific forms without departing from the spirit or essential characteristics thereof. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiments of the present invention.

What is claimed is:

1. A conveying apparatus comprising:

a conveyor including an upstream conveyor configured to convey a sheet, a switchback roller configured to feed the sheet in reverse by receiving and conveying the sheet from the upstream conveyor by a normal rotation operation and then conveying the sheet by a reverse rotation operation, and a downstream conveyor configured to convey the sheet fed in reverse by the switchback roller;

an intermediate discharge port arranged downstream of the switchback roller in a conveyance direction of the sheet conveyed by the normal rotation operation of the switchback roller;

a sheet discharger arranged downstream of the intermediate discharge port in a conveyance direction of the sheet conveyed by the reverse rotation operation of the switchback roller, the sheet discharger having at least one roller pair and being configured to directly discharge printed sheets from the conveyor to a stacker; and a controller configured to, upon occurrence of a sheet jam in the downstream conveyor, discharge a sheet in the upstream conveyor from the intermediate discharge port by controlling an operation of the switchback roller depending on an operation status of the switchback roller at a time of the occurrence of the sheet jam, and then stop sheet conveyance by the conveyor, wherein the downstream conveyor comprises a downstream conveyance roller configured to receive a sheet from the switchback roller and convey the sheet, and upon the switchback roller being in a reverse rotation operation at the time of the occurrence of the sheet jam in the downstream conveyor and a sheet being conveyed by the switchback roller not having reached the downstream conveyance roller, the controller is configured to switch the operation of the switchback roller to the normal rotation operation before the sheet being conveyed by the switchback roller reaches the downstream conveyance roller, discharge the sheet being conveyed by the switchback roller at the time of the occurrence of the sheet jam from the intermediate discharge port, and then discharge the sheet in the upstream conveyor from the intermediate discharge port.

2. The conveying apparatus according to claim 1, wherein, upon the switchback roller being in the normal rotation operation at the time of the occurrence of the sheet jam in the downstream conveyor, the controller is configured to continue the normal rotation operation of the switchback roller, discharge a sheet being conveyed by the switchback roller from the intermediate discharge port if a sheet being conveyed by the switchback roller is present at the time of the occurrence of the sheet jam, and then discharge the sheet in the upstream conveyor from the intermediate discharge port.

3. The conveying apparatus according to claim 1, wherein, upon the switchback roller being in a reverse rotation operation at the time of the occurrence of the sheet jam in the downstream conveyor and a sheet being conveyed by the switchback roller having reached the downstream conveyance roller, the controller is configured to switch the operation of the switchback roller to the normal rotation operation after the sheet being conveyed by the switchback roller exits the switchback roller, and discharge the sheet in the upstream conveyor from the intermediate discharge port.

* * * * *